United States Patent [19]

Manning

[11] 4,184,837

[45] Jan. 22, 1980

[54] COMBUSTION CONTROL SYSTEM

[75] Inventor: William P. Manning, Tulsa, Okla.

[73] Assignee: Combustion Engineering, Inc., Windsor, Conn.

[21] Appl. No.: 675,109

[22] Filed: Apr. 21, 1976

[51] Int. Cl.[2] ..... F23H 1/02

[52] U.S. Cl. ..... 431/90; 236/15 R; 431/12

[58] Field of Search ..... 431/90, 12; 137/6; 236/15 R; 239/419.5

[56] References Cited

U.S. PATENT DOCUMENTS

| | | | |
|---|---|---|---|
| 1,510,039 | 9/1924 | Canfield | 239/419.5 |
| 1,935,237 | 11/1933 | Bryant | 431/12 |
| 2,395,384 | 2/1946 | Ziebolz | 431/90 |
| 2,466,100 | 4/1949 | Harrah | 239/419.5 |
| 3,164,200 | 1/1965 | Reed | 239/419.5 X |
| 3,549,089 | 12/1970 | Hamlett | 431/12 X |

*Primary Examiner*—Edward G. Favors
*Attorney, Agent, or Firm*—Arthur L. Wade

[57] ABSTRACT

A fluid fuel burning system is mounted in a firetube and generates heat of combustion which is transferred to industrial fluid flowing through a vessel in which the firetube is mounted. The air for combustion flows into the burner as primary air mixing with the fluid fuel and a secondary air which is regulated as it flows to the combustion being completed downstream of the burner. The regulation is carried out with a damper positioned in the entrance to the firetube.

1 Claim, 2 Drawing Figures

COMBUSTION CONTROL SYSTEM

BACKGROUND OF THE INVENTION

1. Field of the Invention

The invention relates to regulating the flow of fuel and secondary induced air to an aspirating burner mounted in a firetube during operation of the burner and when the burner is shut down. More specifically, the invention relates to automatic regulation of a damper controlling air flowing into a firetube during burner operation and shutdown.

2. Description of the Prior Art

The relation of excess air flow to the thermal efficiency of a combustion process is well known. It was not surprising, when investigating aspirating burners for which secondary air is not controlled, to find excess air increasing to as much as 250% at low firing rates. The gross thermal efficiency of these uncontrolled systems ranges from 62% at high firing rates to 50% at low firing rates.

Low efficiency, due simply to excess air, cannot be tolerated during the present energy shortage. But, this is not the only problem. When the aspirating burner system is temporarily shut down, ambient air is drawn by the exiting heated air through the firetube and cools the fluid being heated by the burner system. This drafting through the firetube is a further loss of energy which is now in critically low supply.

The present technology calls for control of secondary air to the aspirating burner mounted in a firetube. First, automatic control of secondary air to raise the thermal efficiency over the entire range of burner operation is required. Second, control of the drafting through the firetube during the shutdown periods of intermittent firing is also demanded.

SUMMARY OF THE INVENTION

It is an object of the present invention to regulate automatically secondary air flow to a firetube-mounted aspirating burner in parallel with regulation of fuel flow to the burner from temperature.

Another object of the invention is to exclude positively drafting of ambient air through the firetube during the period the aspirating burner is shut down.

The invention contemplates an aspirating burner mounted more or less axially in the entrance of a firetube. The invention is embodied in a burner, so mounted, in combination with a pivoted damper formed to fit about the burner and its mount so the secondary air flowing into the tube will be controlled by the damper pivoting over its normal range of burner operation.

The invention further contemplates the damper being positioned in parallel with the regulation of fuel flow to the aspirating burner to generate combustion efficiently.

Further, the invention contemplates the control system for the damper closing the firetube opening about the burner and its mount when the burner is shut down to obviate drafting through the firetube.

Other objects, advantages and features of the invention will become apparent to one skilled in the art upon consideration of the written specification, expended claims, and attached drawing, wherein;

DESCRIPTION OF THE PREFERRED EMBODIMENT

THE GENERAL PROBLEM

Figure 1:
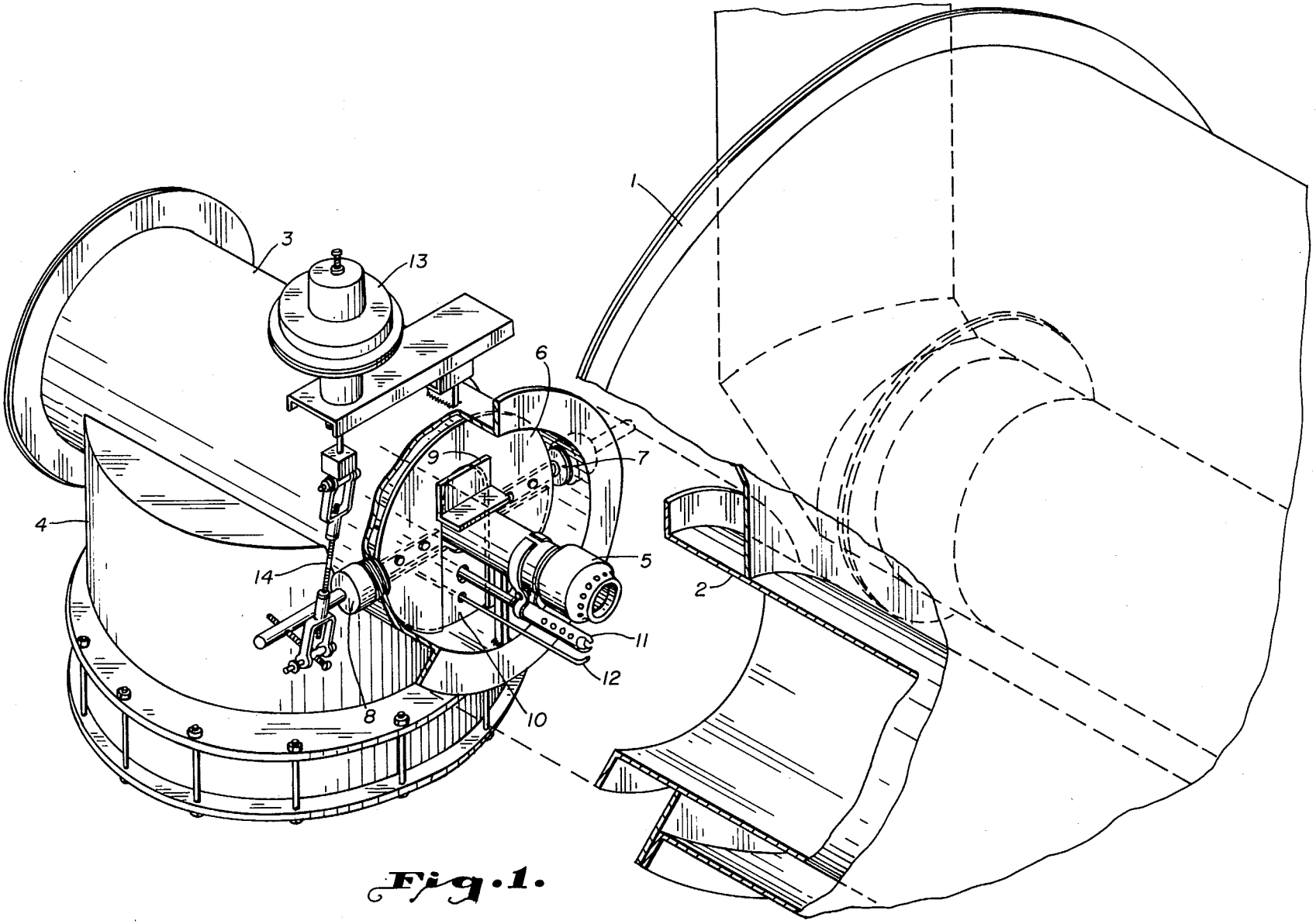
FIG. 1 is a perspective view of that section of a firetube in which an aspirating burner is mounted and a damper pivoted to control air entering the firetube around the burner and its mount, all embodying the invention.

A graph showing how the gross thermal efficiency (GTE) depends on the stack gas temperature and excess air will readily demonstrate the importance of controlling the fuel-air ratio in a combustion process. As an example, in indirect heaters with the stack gas at 1000° F., the GTE drops 0.18% for every 1% increment increase in excess air.

The prior art designs the firetube and stack to provide 20% excess air at the higher firing rate of the aspirating burner. At the lower firing rate, the stack gas temperature and the associated drafting do not decrease enough to prevent operation far above 20% excess air. Then, when the main burner is shut off, leaving only the pilot light on, the continuing stack drafting cools the heater. Of course this means that when the main burner relights, the heat which has been lost by drafting must be combustion at the burner before the heater can again operate at maximum capacity.

Some control of secondary air has been practiced in the prior art. A damper has been adjusted manually in the firetube to roughly compensate for location altitude, burner orifice size, operating gas pressure at the burner, etc. However, in this particular practice, with aspirating burners, complete and automatic regulation over the full range of burner operation has not been implemented. Certainly no effort has been made to solve the drafting problem on shutdown from a single control system.

ACTUAL REDUCTION TO PRACTICE

To reduce the invention to practice, a firetube with a 10-inch diameter was mounted in a heating shell 36 inches in diameter and 10 feet in length. At the high rate of firing of the burner, the transfer of heat to the water bath was in the order of 0.625 MM BTU/Hr. A 2-inch burner was available, and a 12×750 T-type flame arrestor was also mounted on the firetube.

The damper was constructed from ⅛-inch steel plate. It was provided with the horseshoe configuration shown in the drawings. The effect of this damper was calibrated by adjusting its position manually and measuring the $O_2$ concentration of the stack gases with a Beckman oxygen analyzer.

The simple baffle, pivoted in position, proved ineffective when rotated more than 30° from the closed position. Also, at low fire, with the damper closed, the $O_2$ content of the stack gases was 8 to 10%. This indicated 60 to 90% excess air. At this point it was clear the dampening provided was inadequate to achieve the objects of the invention.

Refer now to FIG. 1. A portion of the heater shell is indicated at 1. The firetube 2 is mounted in the shell 1 and the entry section 3 has been sectioned in the drawing to disclose the damper in relation to the burner. Although incidental to the invention, the flame arrestor is within sub-housing 4. All air reaches the burner 5 through sub-housing 4.

The horseshoe-shaped damper 6 is pivoted at 7 and 8 about a shaft extended through the wall of the firetube section 3. FIG. 1 represents that efficient dampening is obtained as the damper 6 is brought against upper barrier structure 9 and lower barrier structure 10. These two plate structures were discovered to be necessary to make the damper structure an effective regulator of secondary air.

Lower plate 10 covers the entire lower half of the exit duct of the flame arrestor, or entrance to the firetube 2, depending upon the point of analysis. This plate blocks off the open area around pilot 11 and ignition rod 12 below burner 5.

The upper plate 9 is positioned on the burner mount so it will cover the area just above the burner where damper 6 is cut away to allow for pivoting about the burner 5 and its mount. The result of including these two barrier plates is to positively block off all air flow when the damper 6 is closed except, of course, for that small amount of air flowing through the main burner to the pilot. The damper, and its barrier plates, then function as intended in the range of damper positions required. Next, the automation of the damper was brought about.

CONTROL SYSTEM

Control of the pivoting of a damper is old art. Diaphragm actuator 13 is mounted as disclosed in FIG. 1. In the reduction to practice a ¼-inch turnbuckle 14 served as adjustable linkage. The maximum travel of the actuator selected was only ⅞ inches and this made the level arm for turning the damper very short, i.e. ½ inch. Through this linkage, the actuator easily overcame the friction of bushings of the damper shaft and the air pressure on the damper. A gas control pressure is generated for the actuator in parallel with a control signal to the fuel supply for the burner.

Figure 2:
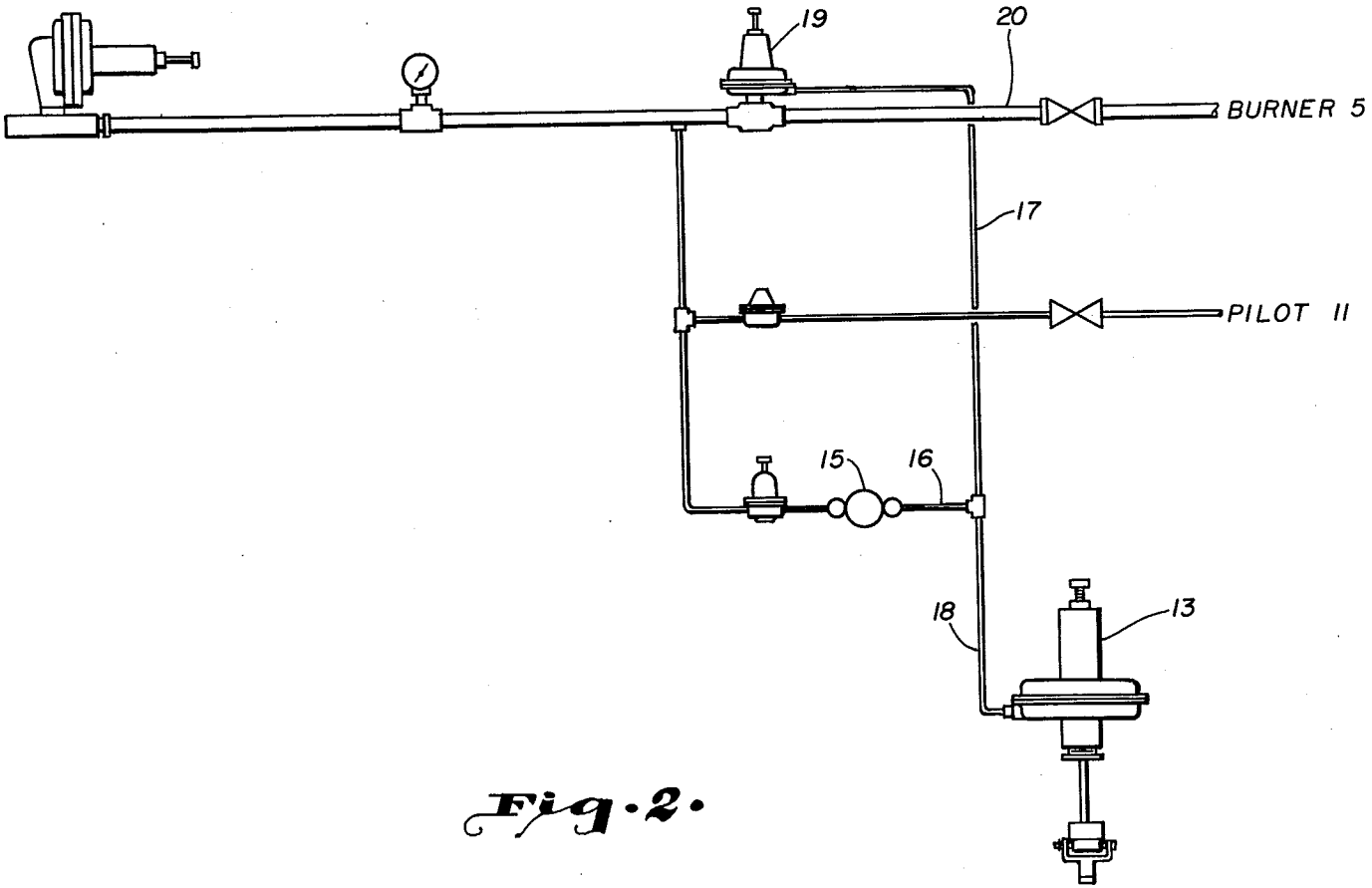
FIG. 2 is a somewhat schematic drawing of the parallel control system for the fuel and air to the burner of FIG. 1.

FIG. 2 discloses the control system. A temperature controller 15 is arranged to respond to the temperature to be controlled. This temperature could be that of the process fluid heated or the temperature of the liquid bath of the heater shell. A combination of these temperatures could be sensed and combined to generate a single control gas pressure.

However it is generated, the control gas pressure is conducted by pipe 16 and branches 17 and 18 to a regulator 19 in the fuel line 20 to burner 5 and actuator 13 for the damper control. By this arrangement the fuel and secondary air are controlled in parallel over the expected range of burner operation.

In the test of the actual reduction to practice, the control signal for the fuel and secondary air was simply generated by pressure reduction of the fuel gas supply. Constant fuel and air flow rates were needed for test runs.

TEST RESULTS

A coil bundle was installed in the test heater. It was one flow path, 14 pass, 2-inch Schedule 80 pipe. Thermometers were installed in the inlet and outlet of this bundle. The measured flow rate of water through the bundle simulated the process stream. The liquid bath temperature was also measured.

Stack gas composition and temperature were measured. All the pertinent data common to a test of this nature were measured and recorded.

A test of the actual reduction to practice established the effect of the damper over the full firing range. Excess air was obtained from the graph of relationships between the $O_2$ content and excess air for combustion gases with 3% water vapor. Efficiency of the firetube was then obtained from the graph showing the dependence of the GTE on the excess air and stack gas temperature.

Several test runs were made with and without the damper. The effectiveness of the damper is clear.

| Burner Heat Release M Btu/hr. | Stack Temperature °F. | $O_2$ in Stack Gas % | Excess Air % | Firetube Efficiency % |
|---|---|---|---|---|
| No Damper | | | | |
| 197 | 780 | 15 | 250 | 42 |
| 394 | 850 | 12 | 130 | 54 |
| 455 | 950 | 8 | 58 | 62 |
| 759 | 1020 | 7 | 45 | 61 |
| 885 | 1050 | 6 | 35 | 62 |
| With Damper | | | | |
| 242 | 800 | 5 | 28 | 70 |
| 383 | 630 | 2.0 | 10 | 76 |
| 501 | 870 | 4 | 22 | 68 |
| 577 | 1000 | 2.1 | 10 | 67 |
| 713 | 1020 | 1.1 | 5 | 68 |
| 789 | 1050 | 1.5 | 7 | 67 |
| 830 | 1090 | 3.0 | 15 | 65 |

The excess air was controlled to less than 30% with the damper and the GTE was always over 65%. The excess air is excessive at low fire when no damper is used, dropping the GTE to 42%. Because the stack was properly sized for the release of 0.9 to 1.0 MM Btu/hr. for the rated capacity of 0.625 MM Btu/Hr., it can be seen there is little difference at high fire, with and without the damper. While it would have been even better to have more data without the damper, the effect of the damper is clear from this test. At high fire the damper increases the GTE from 62% to 65% and at low fire from 42% to 70%.

CONCLUSION

The control of the aspirating burner has been neglected in the prior art. Specifically, the factor of excess air has not been clarified as to its effect on efficiency. Now the energy shortage causes many combustion systems, including those using the aspirating burner, to be revalued and improved.

Of course, a damper in the exhaust of the firetube would be mechanically easier to install, but this is a severe environment for mechanisms that move. Going to the entrance of the firetube, the mount of the burner offers a mechanical barrier to the pivoting damper.

The flat plate of the damper is provided a central cut to give the damper an overall horseshoe configuration. Pivoted from the sides of the tube, this damper will regulate the flow of air into the tube and around the burner mounted more or less axially in the tube entrance.

By the very nature of the damper configuration, the damper will not completely seal about the burner mount when it is pivoted to a position at a right angle to the tube axis. Therefore, two plates are provided to cooperate with the damper at its shut-off position. The first is below the burner and the second is above the burner. When the damper comes against these plates, the air flow is substantially sealed from the tube at the burner and mount.

From the foregoing, it will be seen that this invention is one well adapted to attain all of the ends and objects hereinabove set forth, together with other advantages which are obvious and inherent to the apparatus.

It will be understood that certain features and subcombinations are of utility and may be employed without reference to other features and subcombinations. This is contemplated by and is within the scope of the invention.

As many possible embodiments may be made of the invention without departing from the scope thereof, it is to be understood that all matter herein set forth or shown in the accompanying drawings is to be interpreted in an illustrative and not in a limiting sense.

The invention, having been described, what is claimed is:

1. A combustion control system including an aspirating burner, including, a firetube adapted to be mounted in a vessel containing a medium to be heated, an aspirating burner mounted in the entrance to the firetube and drawing primary air directly in to mix with fuel supplied the burner, a first plate mounted across the firetube entrance below the burner, a second plate mounted across the firetube entrance just above the burner, a damper formed of flat plate cut to a horseshoe configuration and pivoted from the side of the firetube to cooperate with the first and second plates to positively block off all air flow around the burner and through the tube when the damper is positioned to close the tube with the damper alternatively regulating the secondary air flowing into the entrance to the firetube and about the burner to the combustion process generated at the burner exit, a first regulator in the fuel supply line to the burner, a second regulator connected to position the damper, and a controller arranged to respond to the temperature of a fluid heated by the firetube and generating a control signal connected in parallel to the first and second regulators, whereby the excess air to the combustion of the aspirating burner is regulated automatically in parallel with the regulation of the fuel to the burner over the range of firing rates of the burner.

* * * * *